United States Patent [19]

Pressman

[11] 4,246,495

[45] Jan. 20, 1981

[54] TELEVISION MONITOR AND CONTROL

[76] Inventor: Jerome Pressman, 4 Fessenden Way, Lexington, Mass. 02173

[21] Appl. No.: 948,964

[22] Filed: Oct. 5, 1978

[51] Int. Cl.[3] ..... H01H 43/06; H01H 43/10

[52] U.S. Cl. ..... 307/141; 200/38 D; 200/38 DB; 200/38 FB

[58] Field of Search ..... 307/141, 141.8; 200/33 R, 35 R, 38 F, 38 FB, 38 D, 38 DA, 38 DB, 38 DC

[56] References Cited

U.S. PATENT DOCUMENTS 3,879,332 4/1975 Leone ..... 200/38 FB X

*Primary Examiner*—L. T. Hix

*Assistant Examiner*—James L. Dwyer

*Attorney, Agent, or Firm*—Wolf, Greenfield & Sacks

[57] ABSTRACT

The apparatus may be embodied as a self-contained unit associated with the television set or integrated into the television set. The control is basically in two functions, one which is set for programming the availability of use of the television set at predetermined time intervals of the day, and the other which is set for controlling total usage of the television set over a given period such as a 24-hour period. In the preferred embodiment the two functions are set and repeated automatically every day. In another version different settings are allowed for both control functions for weekdays and weekends. In still another version each day of the week may be set separately with regard to both control functions.

11 Claims, 5 Drawing Figures

TELEVISION MONITOR AND CONTROL

BACKGROUND OF THE INVENTION

The present invention relates in general to a television monitor and control apparatus. The apparatus of this invention may be embodied as a self-contained unit associated with the television set or may be integrated into the television set. The control in accordance with the invention is manually settable and preferably automatically repeatable. This control is twofold including a settable control for determining the sub-periods of availability of the use of the television set during say a 24-hour period, and a second settable control for determining the total accumulated daily use of the television set to limit such use over a given period.

The widespread use of television has caused concern with regard to the effects of excessive use of television by children due to the passivity of watching the television and also due to the specific content of television programs such as an excessive amount of violence now common in television watching. This problem is exacerbated by the change in the nature of the family to a family wherein both parents may be working or where there is a single parent family thus causing increased isolation of children and excessive watching of television. Many homes have the availability of a number of television sets. The attempt of parents to control television watching by setting reasonable limits has become more difficult and the limitations on television viewing have become a source of considerable friction within the family. As a result, the phenomenon of TV viewing by children and the effects on the children have become the subject of many studies by the government and other agencies.

The television monitor and control apparatus of this invention is a solution to this problem by providing an aid to the parents in setting limits within which the child is free to use the television set. With the apparatus of this invention the child is free to exercise his or her responsibility by selecting programs and budgeting his or her time within the constraints set by the parents or arrived at by mutual discussion. Also, in accordance with the invention the limits that are set may be changed at any time quite readily. Also, in accordance with the invention, once the limits have been set and locked in the apparatus, these set limits are automatic and thus the parents no longer have the job of controlling the child's TV viewing time thus reducing friction and alleviating the waste of time usually involved in the repetitive and often emotionally charged interactions between parents and children.

The prior art shows devices for providing control of television sets. See for example, the Noiles U.S. Pat. No. 3,581,029 which teaches the use of an accumulator alone for limiting total use within a period of time such as within a 24-hour interval. This device, however, permits viewing at virtually any hour as long as the accumulated time has not been reached. This device thus does not limit the child's viewing to only prescribed intervals of the day.

Accordingly, one object of the present invention is to provide a control that both limits the total viewing time within a period and also restricts viewing to certain intervals within the period.

SUMMARY OF THE INVENTION

The television monitor and control apparatus of the present invention may be embodied either as a self-contained unit for use in association with an existing television set, or may be integrated into the television set when it is constructed. In both versions of the invention there are two settable dials or the like for controlling the two functions in accordance with the invention. The first function is set to define one or more predetermined intervals during say, a 24-hour period when the television set is permitted to operate. Thus, in a simple version, this function may be set to permit viewing in the morning and end possible viewing at a preselected time in the evening. In another version the system may provide for more than one viewing interval in a 24-hour period.

The second function in accordance with the invention is set for determining the total accumulated daily usage of the television set over a period such as a 24-hour period. The first and second functions in accordance with the invention are interrelated in that accumulation of time in accordance with the second function can only occur during permitted intervals in accordance with the first function. In accordance with the second function, the total television viewing time is measured and displayed on the timer which has a predetermined time limit for the day or other period set into it. When this accumulated time limit is reached, the television set is rendered inoperable until the timer is automatically reset such as may occur at the end of the day. In another version of the invention the resetting may occur in six-hour intervals to permit say one hour's worth of viewing in a six-hour period.

In accordance with the invention it is preferred to have a 24-hour resetting period wherein the both functions are repeated automatically each day. However, it is possible at any time to alter the settings of either functions. In another version of the invention the two control functions may be set differently for weekdays and weekends. In still another version, different settings may be provided for each day of the week separately.

The embodiment disclosed herein is an electromechanical embodiment, but the principles may also be embodied by using electronic circuitry. In the disclosed embodiment, there is provided a first timer for controlling the first function and a second timer for basically controlling the second function. The first timer has contact means associated therewith for enabling operation of the second timer only during predetermined intervals of the day. The second timer accumulates time in accordance with power being applied to the television set. The first timer at a predetermined time such as at the end of a day causes a resetting of the second timer to a zero accumulation. In accordance with the preferred embodiment there is also provided a mode switch which can permit either the automatic operation in accordance with the invention, or on and off modes.

DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
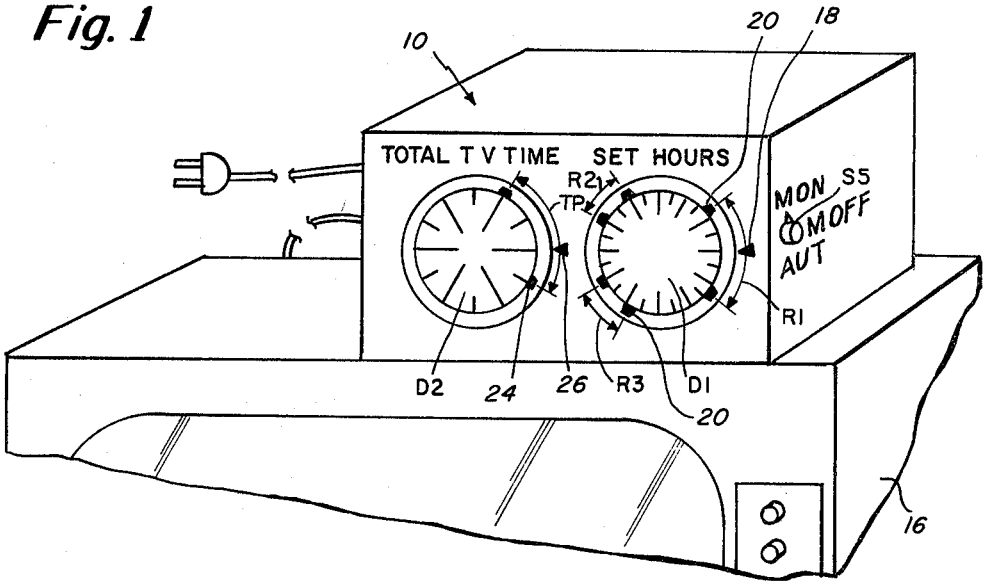
FIG. 1 is a perspective view showing the dial controls in accordance with this invention embodied in a self-contained unit associated with a television set.
Figure 2:
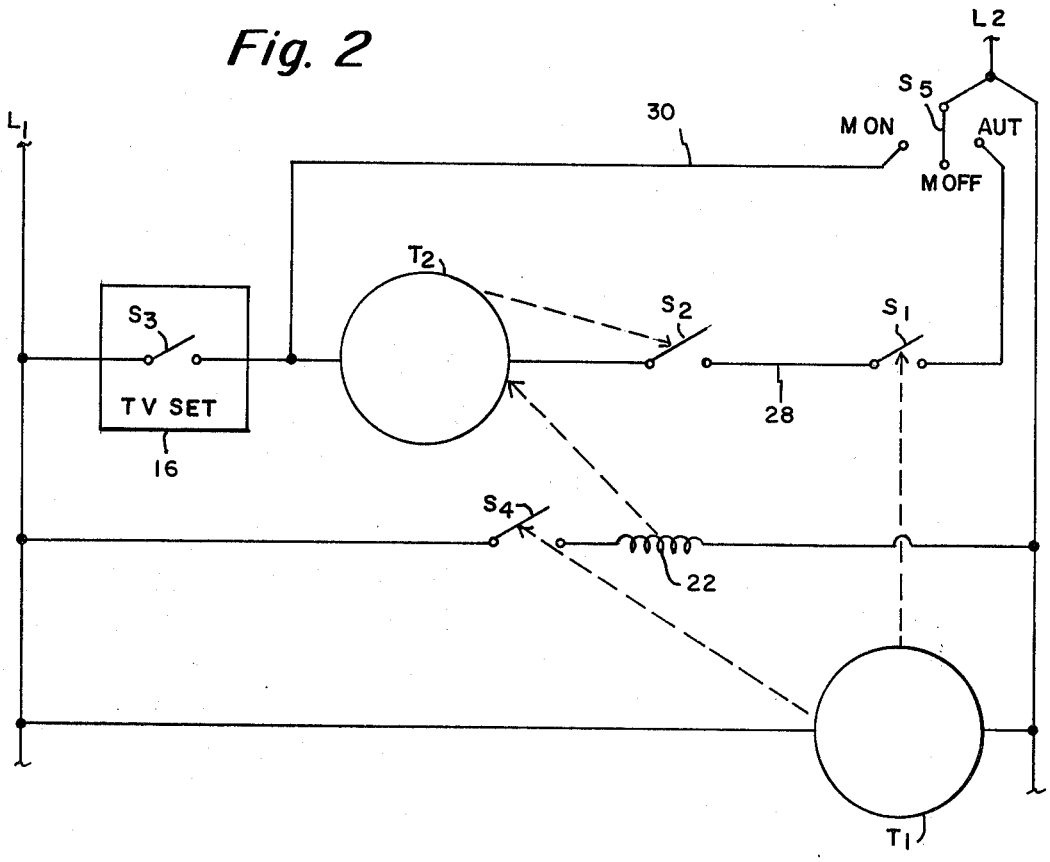
FIG. 2 is a circuit diagram showing the timers controlled from the dials of FIG. 1.

A basic embodiment of the present invention is depicted in FIGS. 1 and 2. FIG. 1 shows a box 10 containing the device of the present invention shown schematically in the circuit of FIG. 2. The embodiment illustrated in FIG. 1 is a self-contained unit, but it is understood that the invention may also be practiced by a similar apparatus that is integrated into the television set itself. In FIG. 1 the control box 10 couples between the AC source and the television set. The control box 10 supports control dials D1 and D2 which are associated, respectively, with the timers T1 and T2 shown in the circuit of FIG. 2.

The dial D1 controls the timer T1 to set the time interval or intervals during which the set may be operated. The timer T2 which may be termed a totalizer or accumulator accumulates the total viewing time of the television set preferably providing a continuous display of accumulated time. The accumulator timer T2 is resettable at predetermined intervals such as at daily intervals. Herein reference is made to these timers as also being time switches. However, it is understood that multi-cam switching devices may also be used in their place. Each of the timers T1 and T2 shown in FIG. 2 may be of conventional design. Also, digital time clocks with controllable switches may be used in place of these electromechanical time devices.

In addition to the dials D1 and D2 shown in FIG. 1, there is also provided a mode switch S5 also depicted in the circuit of FIG. 2. The control box 10 shown in FIG. 1 is preferably a locked compartment preventing any alteration of the settings once they have been made. In FIG. 1 although the dials are shown as being accessible, the particular settings establishing the different time periods are preferably within the box 10. The dials D1 and D2 are more for display purposes with the dial D1 indicating the time of day and the dial D2 primarily indicating the number of hours that have been accumulated. There are basically two cords connecting from the control box 10, both of which locked into the box 10 so that there cannot be a by-passing of the control box. Since the plug for all televisions is currently locked into the television set, the entire system is secure and cannot be by-passed unless the television is dismantled. In the alternate version wherein the control is built into the television, the settings may be secured by means of a door with a lock in the television control panel.

The embodiment depicted in FIGS. 1 and 2 may be a 24-hour version of the invention. FIG. 2 shows the timers T1 and T2 associated, respectively, with the dials D1 and D2 shown in FIG. 1. The timer T1 may be a synchronous motor time switch with a series of on and off trippers programmed to operate a switch S1 which is in series with the television set 16 depicted by a switch S3 which couples power to the television set from the AC lines L1, L2. In FIG. 1 the dial D1 makes a complete rotation on a 24-hour period with the arrow 18 indicating the position of the dial D1 at any one time. It is noted that the timer T1 is always disposed across the AC line and thus the dial D1 repeatedly rotates through one rotation for each 24-hour period. In FIG. 1 the dial is shown in the range R1 defined between one of three pairs of stops 20. These stops or markers 20 correspond with trippers of the timer for demarcating certain operating intervals in the 24-hour period. Thus, in FIG. 1 there is shown ranges R1, R2, and R3 demarcating different predetermined intervals of the day in which television watching is permitted. During the ranges R1, R2 and R3, the switch S1 of FIG. 2 is closed while outside of those ranges the switch S1 is open thus opening the path to the timer T2 and the television set 16 not permitting any television viewing even if the switch S3 is closed.

The second function in accordance with the present invention, namely the display and control of accumulated television viewing time, is exercised by means of a resettable total elapsed time device T2 which may be operated by its own synchronous motor in which a time limit has been set. As depicted in FIG. 2 the timer T2 is in series with the television set. It records the operating time of the television set. The timer T2 effectively integrates the on time of the television set regardless of the number of times the set may be turned on and off. When the integrated time reaches the time limit set on the timer T2, then the switch S2 associated with timer T2 and in series therewith is opened under control of the timer T2 to terminate further viewing. At some convenient time period such as at midnight, the timer T1 operates to close the switch S4 thus energizing the coil 22. The coil 22 is associated with timer T2 causing a resetting thereof. In this way each new day starts off with the television set operable and with T2 reset to its zero accumulation. In this connection in FIG. 1 it is noted that the dial D2 has associated therewith two markers 24 which indicate the total time accumulation which is shown as a total accumulation of three hours in FIG. 1. The arrow 26 shows one hour having been accumulated assuming that the dial D2 rotates clockwise. The markers 24 are not settable by the child but are associated with knobs or the like within the box 10 which may be set by the parent and which control certain trippers that in turn control switches such as switch S2. Thus, in the embodiment of FIG. 2 at the beginning of each day, the timer T2 is in a reset state with the switch associated therewith in its closed state permitting television watching. After the timer T2 has detected a preselected interval of viewing, the switch S2 opens thus preventing any further television viewing. At the end of the day, the switch S4 is operated to reset the timer T2 by way of the coil 22 thus again closing the switch S2 for permitting viewing in the next 24-hour period.

The timer T2 may be operated off of its own synchronous motor or alternatively may be operated off the synchronous motor of the timer T1. In this alternate version a current passing in the line 28 operates a clutch by means of a relay in the line 28 between timer T2 and switch S2. This arrangement permits timer T2 to be driven by the motor of timer T1. In this way the dial associated with timer T2 moves when and only when the television set is operating without the need for a separate motor of its own. Various types of clutch operated units are commercially available for operation in this manner. It is also important to note that the timer T2 does not reset when the television set is turned on and off, or when power is turned on and off. In the automatic mode in accordance with this invention, the timer T2 is reset, for example, at the end of each day by the closing of switch S4 controlled from the timer T1. The reset mechanism of timer T2 may include a standard ratchet and pawl arrangement which operates so that only when the pawl is positively moved by the coil 22 does a spring (not shown) bring the timer T2 back to its starting position. Such a reset arrangement is well-known to one skilled in the art of timers. In an alternate arrangement, the mechanical movement of the pawl (not shown) may be initiated directly by a mechanical switch activated by the timer T1.

In the embodiment of FIG. 2 the switches S1 and S2 may be operated off their associated timers by means of direct physical contact or with the use of electronic switches or relays. The scale on the dials D1 and D2 is preferably at least to the nearest half hour. The timers T1 and T2 may also be programmable cam timers.

In FIG. 2 there is also shown a standard three position switch S5 which is also depicted in FIG. 1. This switch selects either automatic control or on and off modes of operation. In the "on" position the control circuit of FIG. 2 is by-passed by means of the lead 30 shown in FIG. 2. In this way the television set can be operated in the usual manner. Although in FIG. 1 this switch is shown exposed, it is preferable to have the switch in the control box 10 so that it is not accessible to the child. In this mode of operation the timer T1 is maintained across the power line and thus the basic timing is not lost but the control is simply by-passed. In the "off" position of the switch S5 the television set is rendered inoperable. In this mode the timer T1 again is operated but the timer T2 does not function.

In the event of a power failure, the timer T1 may be set to the correct time simply by turning the dial D1 to the arrow that indicates the time. In another modification of the invention, there may be provided another reset coil in series with coil 22 for controlling the switch S2. Another version permits the timer T2 to reset itself directly when a time limit has expired and S2 has opened. This may be achieved by having timer T2 initiate the resetting of the coils independent of the closing of switch S2 operated by timer T1.

Figure 3:
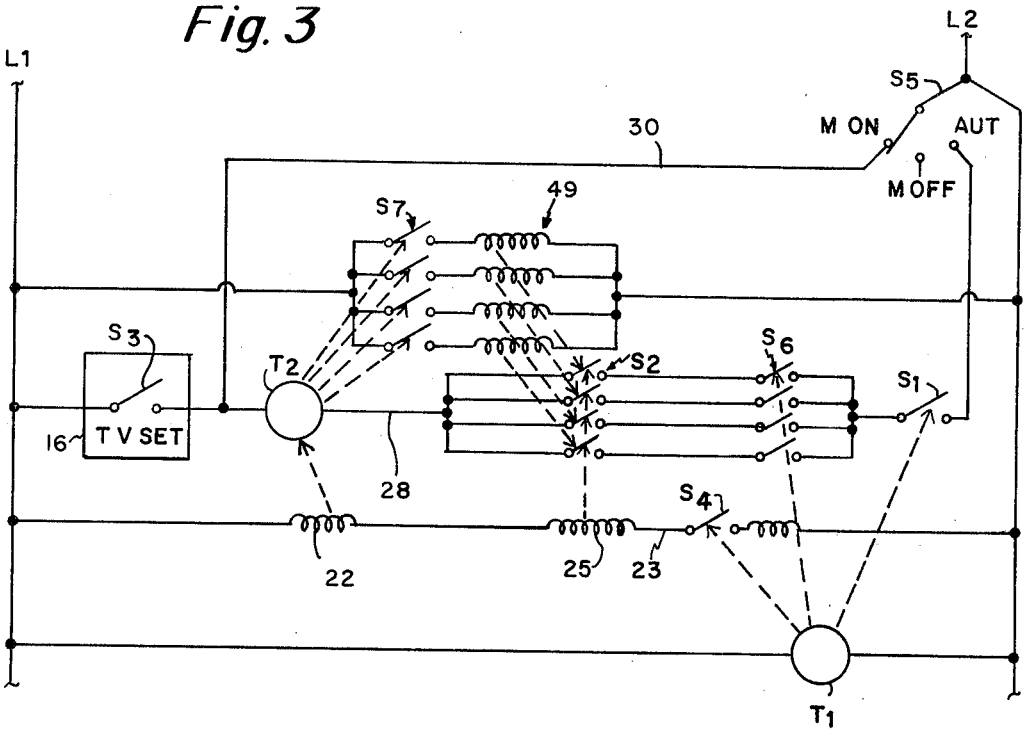
FIG. 3 is a second circuit diagram for a slightly more complex embodiment of the invention.
Figure 4:
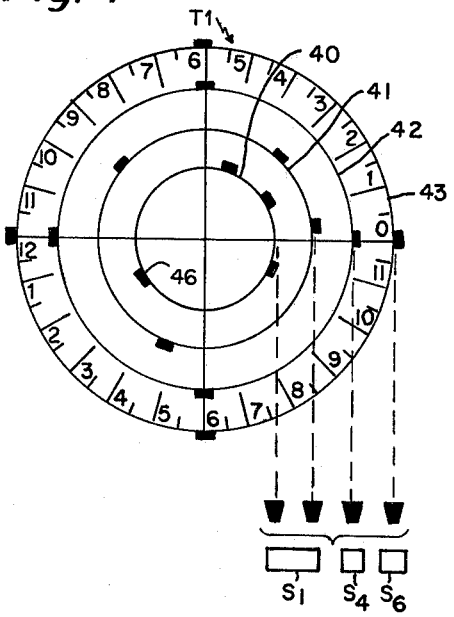
FIG. 4 shows a schematic representation of the first timer of FIG. 3 for quarter control.
Figure 5:
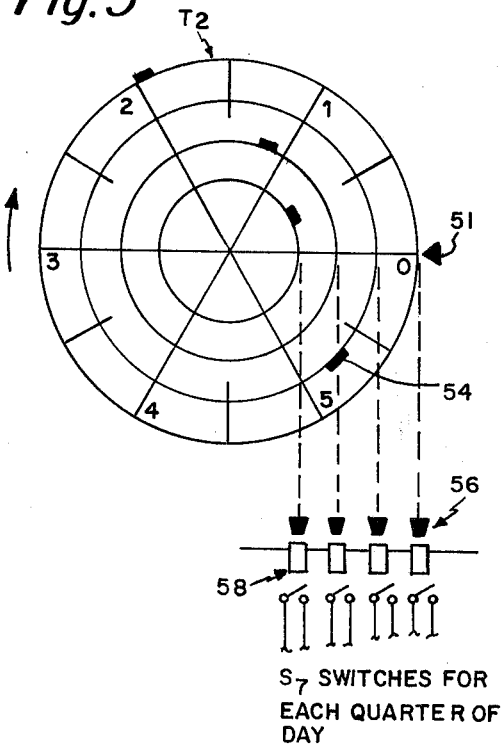
FIG. 5 is a schematic representation of the second timer of FIG. 3 depicting total TV timer control.

FIGS. 3–5 depict a somewhat more complex embodiment of the present invention providing finer control of television viewing by providing controls for different portions of the day. This is accomplished by controlling the accumulated viewing that is permitted individually and separately for various fractions of the day. For example, two hours of viewing may be permitted in the first quarter of the day, three hours in the second quarter, an hour in the third quarter and four hours in the fourth quarter.

In FIG. 3, as is also shown in FIG. 2, there are a number of dotted arrows which depict control from one element of the system to another element. Thus, in FIG. 2 there was depicted one dotted arrow connecting between the coil 22 and the timer T2 to depict the resetting control of the timer T2. in FIG. 3 similar schematic representations are made showing the control in accordance with this embodiment. In FIG. 3 like reference characters are used to identify like parts. Thus, in the embodiment of FIG. 3 there is shown a switch S5 having its common terminal coupled to one of the AC lines, namely line L2. The television set 16 has its on-off switch represented by the switch S3 as was also depicted in FIG. 2. FIG. 3 also shows the timers T1 and T2 with the timer T1 being directly connected across the AC line and the timer T2 being connected in series with the television set in the line 28. Switches S1 and S4 are associated with the timer T1 as in the embodiment of FIG. 2 and there is also shown the coil 22 in series with the switch S4 in line 23. The line 30 also intercouples from the switch S5 to one side of the television set for providing the by-pass operation previously discussed with reference to FIG. 2.

In FIG. 3 it is noted that the timer T1 controls switches S1, S4 and four pulls of switch S6. FIG. 4 schematically depicts the control by timer T1 including separate time tracks 40, 41, 42 and 43. Each of these tracks has markers or trippers 46 associated therewith. The tracks 40 and 41 operate cooperatively with the trippers on track 40 being on trippers for switch S1 and the trippers on track 41 being off trippers for switch S1. Between these two tracks they thus define the intervals in each quarter in which the switch S1 is closed to permit operation of the television set 16. The track 42 controls the switch S4 and it is noted that the trippers on track 42 provide for a resetting on a quarter of a day basis. Thus, every six hours the switch S4 is closed under control of the timer T1 to energize the coil 22 and reset the timer T2 on a quarter of a day basis. The control track 43 has its trippers positioned similarly to the control track 42. The track 43 controls switch S6. This control is such that every six hours, one of the four poles of the switch S6 is closed. Thus, the timer T1 operates so that only one pole at a time is closed and this pole is closed for a six hour interval. In FIG. 3 it is noted that each of the poles of switch S6 has associated therewith a pole of switch S2. Thus, the switch S6 essentially enables control during quarters of the day by way of the particular state of its associated pole of switch S2.

The timer T2 is controlled as to its resetting from the coil 22 but there is also shown the dotted arrows coupling to the four pole switch S7 which has coils 49 associated with each pole of the switch S7. The operation of these coils in turn controls the contacts of switch S2. FIG. 5 schematically depicts the timer T2 with its tracks Q1, Q2, Q3 and Q4. In the position of FIG. 5, the timer is reset with the arrow 51 pointing to the zero position of the timer. It is noted that there are a series of markers 54 associated with each of the tracks for determining different intervals within each six hour interval. It is also noted that the timer T2 is separated into six equal intervals corresponding to six hours or a quarter of the day. There are four trippers 56, one associated with each of the tracks Q1–Q4. FIG. 5 also shows the buttons 58 that close the switches S7. Also, in FIG. 5, it is noted that each of the markers represent different time intervals associated with the different quarters of the day. Thus, the first quarter may be represented by the track Q1 which shows a two-hour interval. Q2 shows an interval over 5 hours, Q3 shows an interval slightly over one hour and Q4 shows a relatively short interval of about one half hour.

In the operation of the embodiment of FIGS. 3–5, for a given six hour period, one of the poles of switch S6 is closed and as long as the timer T2 is still accumulating time, the pole of switch S7 corresponding to the same six hour interval is open and the corresponding switch S2 is closed. Thus, power is provided by way of one contact switch S6 and one contact of switch S2 to the timer T2 and furthermore to the television set 16. During the predetermined six hour interval, if the time that is set on timer T2 accumulates, one of the markers 54 operates a tripper 56 to close the corresponding pole of switch S7 energizing one of the coils 49. This operation causes an opening of the corresponding pole of switch S2 thus interrupting power to the television set 16. If the present accumulated time has not been attained during the six hour interval, the timer T2 is reset to a zero condition by a coil 22 at the end of the six hour interval by virtue of the operation of the switch S4 discussed hereinbefore. In line 23 it is noted that there is also a resetting coil 25 which may also control the poles of switch S2 so as to close all of these in a reset condition. Once one six hour interval has been finished, then the timer T1 commences to an adjacent pole of switch S6 and this pole now selects a different contact of S2 and it essentially monitors this contact. This separate contact of S2 is now associated with a different time interval as determined by the timer T2 in accordance with a setting such as shown in FIG. 5.

In still another version of the present invention not specifically described herein, there may be provided for different settings for weekdays and weekends, while using a 24-hour clock. The circuit used is similar to that shown in FIG. 3. For the weekend-weekday version, there are preferably two poles of switch S2 and two poles of both switches S1 and S6. In this embodiment, the timer T1 preferably has two concentric rings of trippers, each containing on and off trippers for weekends and weekdays, respectively. The switching from weekday to weekend circuits is controlled by timer T1 through a standard idler switch (in one version a seven-sided cam) which controls switch S6 by sequential rotation so that, for example, at Friday, 2400 hours, the weekend circuit is shifted in and on Sunday, 2400 hours, the weekend circuit is shifted out. The resetting function is similar to that described in connection with FIGS. 2 and 3.

In still another version of the present invention a seven day clock may be used to provide a further sophistication of programming. In this way different time intervals could even be set up for each day separately.

What is claimed is:

1. Apparatus for controlling the operating time of a utilization means having a switch for controlling the supply of power thereto, said apparatus comprising;

a first timer coupled with the control switch of the utilization means to accumulate the operating time of the utilization means over a predetermined interval, means for setting a desired accumulation time in the first timer, reset means for resetting the first timer to zero accumulated time at the end of the predetermined interval, a second timer associated with the first timer for enabling operation of the utilization means only during a selection period of said predetermined interval, and means for setting the desired selection period, which represents a portion of the predetermined interval, of the second timer, said second timer including means for enabling operation of the first timer only during the said selection period, whereby the utilization means is permitted operation during the selection period but only up to a time limit defined by the set accumulation time.

2. Apparatus as set forth in claim 1 wherein said second timer enables operation of the utilization means by enabling operation of the first timer.

3. Apparatus as set forth in claim 2 wherein said second timer includes control switch means in series with the first timer to permit selective operation of the first timer.

4. Apparatus as set forth in claim 3 including a pair of power lines with the control switch for the utilization means, the first timer and the control switch means of the second timer being coupled in series between the power lines.

5. Apparatus as set forth in claim 4 wherein said second timer is coupled to the power lines to operate continuously as long as power is applied.

6. Apparatus as set forth in claim 5 including a control switch means associated with the first timer for interruption of power to the utilization means after a preselected accumulation registered by the first timer.

7. Apparatus as set forth in claim 1 including means responsive to a preselected accumulation registered by the first timer to interrupt power to the utilization means.

8. Apparatus as set forth in claim 1 wherein said second timer enables operation during at least two separate segments of the predetermined interval.

9. Apparatus as set forth in claim 6 wherein the control switch means of the second timer has separate switch elements and the control switch means of the first timer also has separate switch elements.

10. Apparatus as set forth in claim 9 wherein the second switch elements each demarcate a segment of the predetermined interval and the first switch elements are operated in a preset manner to demarcate accumulation in each segment.

11. Apparatus as set forth in claim 1 including a mode switch for automatic operation and on and off operation.

* * * * *